United States Patent [19]

Gallegos

[11] 3,943,946

[45] Mar. 16, 1976

[54] METHOD AND APPARATUS FOR ISOLATION OF HAIR FROM TREATMENT MATERIALS

[76] Inventor: Ramon Gallegos, 28819 Leah Circle, Palos Verdes Peninsula, Calif. 90274

[22] Filed: Nov. 21, 1974

[21] Appl. No.: 525,733

[52] U.S. Cl. ..... 132/39

[51] Int. Cl.[2] ..... A45D 2/02

[58] Field of Search ..... 132/39, 40, 42, 36, 43, 132/7, 9, 43.1, 38

[56] References Cited

UNITED STATES PATENTS

| | | | |
|---|---|---|---|
| 582,563 | 5/1897 | Wegefarth | 132/40 |
| 1,400,637 | 12/1921 | Szlanyl | 132/36 R |
| 2,819,721 | 1/1958 | Zakon | 132/7 |
| 2,991,790 | 7/1961 | Bonilla | 132/9 |

*Primary Examiner*—G. E. McNeill

*Attorney, Agent, or Firm*—Fulwider Patton Rieber Lee & Utecht

[57] ABSTRACT

An apparatus and method for isolating certain hair sections from other hair sections which are to be treated with hair waving, straightening, bleaching, or dyeing materials. In a hair waving application, each free end portion of a hair section to be protected from the waving solution is rolled onto a conventional curling rod. A sheet of fluid impermeable material is rolled onto the rod with the outer hair turns. A split sleeve is pressed onto the assembly of rolled up hair and sheet, and this seals the rolled up hair from intrusion of the waving solution. The inner end of the hair section can then be rolled onto the sleeve for treatment with the waving solution in the usual manner. In a hair straightening procedure the inner end of the hair section would not be wound onto the sleeve, but would instead be treated with the hair straightening solution. Hair frosting and reverse frosting procedures are performed by separating certain hair tresses and rolling them up in the manner described, thereby isolating such tresses from exposure to the hair frosting or reverse frosting materials.

9 Claims, 6 Drawing Figures

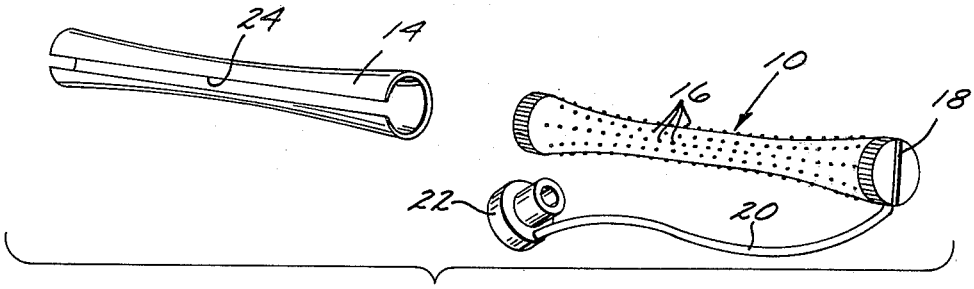
FIG. 1
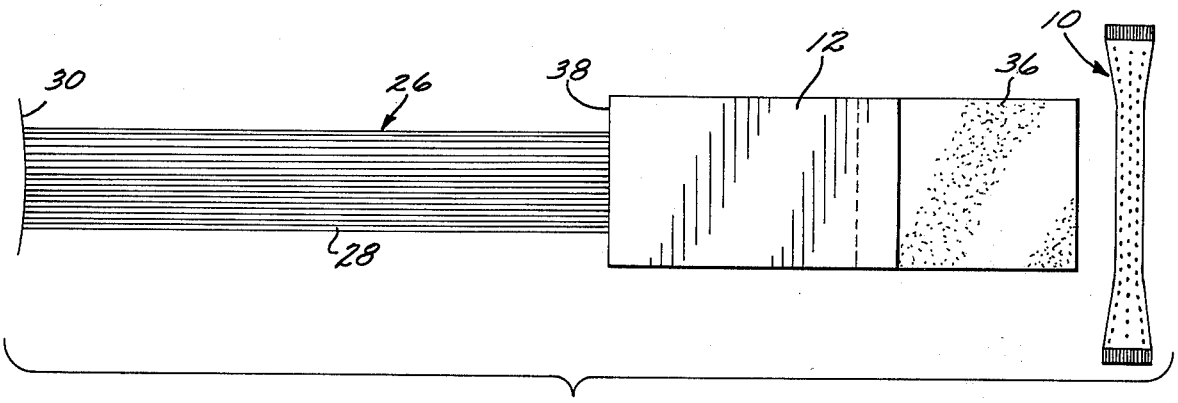
FIG. 2
FIG. 3
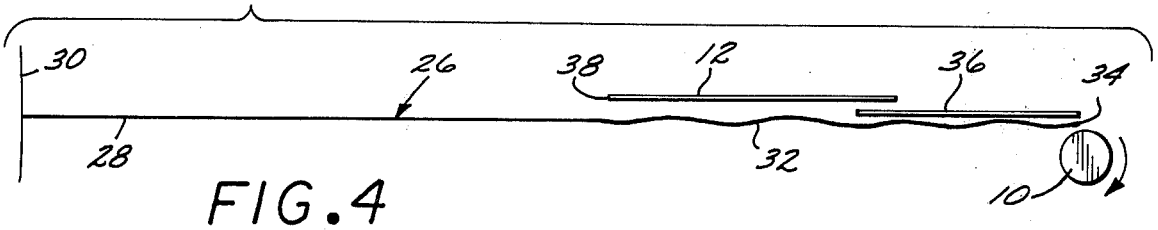
FIG. 4
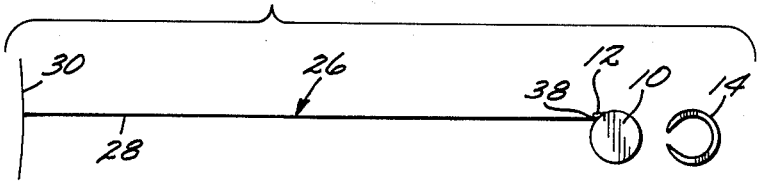
FIG. 5
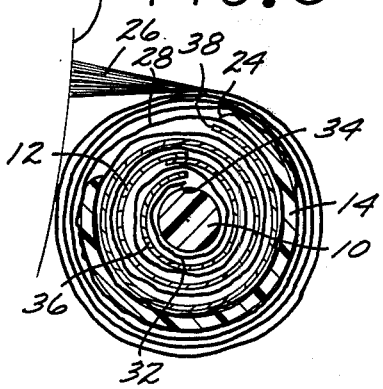
FIG. 6
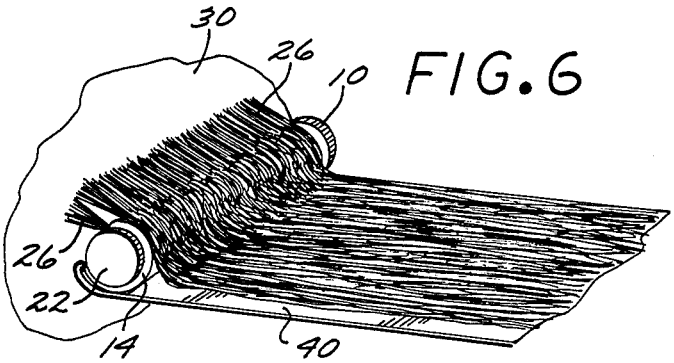

METHOD AND APPARATUS FOR ISOLATION OF HAIR FROM TREATMENT MATERIALS

BACKGROUND OF THE INVENTION

1. Field of the Invention

The present invention relates to an apparatus and method for isolating certain hair sections from other sections to be treated with hair waving, straightening, bleaching, or dyeing material.

2. Description of the Prior Art

In various hair treatment procedures it is important to protect, shield, or isolate certain hair sections from the rest of the hair. For example, in a so-caled "cold permanent" hair curling process a cold waving solution is applied to the hair after it has been wound or rolled onto winding rods or hair curlers. Repeated applications of such cold waving solution to the hair can cause it to become brittle and frizzy. Consequently, when a customer's hair is to be curled it is important to keep the cold waving solution away from any previously treated hair. Heretofore, the separation of the previously curled hair sections from those which are to be treated has been a tedious and time consuming operation.

Hair straightening is another procedure in which it is important to protect previously treated hair from the treatment lotion. U.S. Pat. No. 3,367,345, issued Feb. 6, 1968, entitled "Apparatus and Method for Protecting Old Hair While Straightening New Hair," discusses this problem and discloses one method of protection. According to the patented arrangement a hair section is separated from the main body of hair and that length of the hair section which has been previously straightened is placed upon a length of fluid impermeable paper. The fold or seam of the paper extends lengthwise of the hair section and both the paper and the enclosed hair are rolled up into a croquignole. The unrolled, unstraightened portion of the hair section is then treated with the straightening lotion. This procedure is quite tedious because of the requirement that the hair sections be enclosed on both sides by the paper, and the lotion is not completely kept from leaking through to the already straightened hair.

Hair frosting and reverse hair frosting are other hair treatment procedures in which it is important to protect the hair from the treatment materials. In hair frosting the hair sections to be treated are separated and bleaching material is applied to them. In the reverse frosting process dyeing material is applied. In either procedure care must be taken to surround, contain, or otherwise isolate the hair sections which are treated so that the treatment material cannot reach the rest of the hair.

All of the procedures mentioned require the exercise of painstaking care, which takes time, and which is therefore costly. In addition, the methods of protection of the hair which is not to be treated are often so ineffective that the physical character of the hair or its appearance suffers.

SUMMARY OF THE INVENTION

According to the present invention, an apparatus and method are provided which are operative to isolate relatively quickly and effectively certain hair sections from the rest of the hair to thereby facilitate hair treatment procedures. The apparatus includes the combination of a sheet of fluid impermeable material and a sealing member such as a resilient split sleeve. The sheet is adapted to overlie a hair section which is to be protected or isolated from the hair treatment material. The hair section and the sheet are together wound upon an elongated winding member or curling rod. The resilient split sleeve is sprung upon the curling rod in overlying relation to the wound hair section and sheet so that the sleeve presses upon and seals the hair section and sheet from intrusion of the hair treatment materials.

According to the method of the present invention, the hair to be protected from the hair treatment materials is partially wound upon a hair curler rod, and the fluid impermeable sealing sheet is placed against a hair section to be protected. The sheet and hair section are then wound upon the curling rod, and the split sleeve is press fitted over the wound hair section and sheet to seal the same against passage of hair treatment materials. In the case of a hair curling procedure, only that portion of the hair section which was previously curled is wound on the rod prior to placement of the split sleeve. Thereafter, the uncurled hair is wound about the split sleeve and retained in wound position by the usual hair curler elastic. The curling solution is applied to the wound hair located externally of the split sleeve and the wound sheet and sleeve keep the solution from passing to the hair within the split sleeve.

If a hair straightening procedure is involved, any already straightened hair is first wound on the rod with the sealing sheet, the sleeve is placed in position, and the remaining unstraightened portion of the hair section is left unwound. The unwound hair is then treated with the hair straightening lotion.

In a hair frosting procedure selected sections of hair are completely wound upon the curling rods, with the fluid impermeable sheets being applied to the hair close to the head to surround all of the wound hair. After placement of the sleeve, the remaining, separated unwound sections of hair can be treated with a bleaching agent. If the procedure is a reverse frosting treatment, the unwound hair sections are treated with a dyeing agent rather than a bleaching agent.

The methods of the present invention are quickly and easily performed and are very effective in isolating selected hair sections from the action of various kinds of hair treatment materials.

Other objects and features of the invention will become apparent from consideration of the following description taken in connection with the accompanying drawing.

BRIEF DESCRIPTION OF THE DRAWINGS

FIG. 1 is a perspective view of a typical curling rod and associated sealing sleeve according to the present invention;

FIG. 2 is a partially diagrammatic plan view of a curling rod, and the hair section and papers which are wound together onto the rod;

FIG. 3 is a side elevational view of the elements of FIG. 2;

FIG. 4 is a view similar to FIG. 3, but illustrating the papers and a portion of the hair section wound upon the rod, with the sleeve of FIG. 1 ready to be fitted onto the wound elements;

FIG. 5 is a partially diagrammatic cross sectional view of the elements of FIG. 4 as the same would appear for a hair curling procedure; and FIG. 6 is a partial perspective view of the elements of the present apparatus being utilized in a hair frosting procedure.

DESCRIPTION OF THE PREFERRED EMBODIMENTS

As previously indicated, the present invention is concerned with a means for quickly and easily protecting or isolating selected hair sections from the effect of various kinds of hair treatment materials. As will be seen, the relative ease of use of the present apparatus makes possible the use of the unique methods of hair treatment which are also herein disclosed.

The present apparatus is adapted for use with various hair treatment procedures, but particularly including the cold wave or cold permanent hair curling, hair straightening, hair frosting, and reverse hair frosting. In this regard, the composition of the liquids, lotions, and like agents used in the hair curling, straightening, or frosting procedures form no part of the present invention since suitable compositions are well known to those skilled in the art. Consequently no description of such materials is included in the present disclosure.

The present apparatus comprises, generally, an elongated winding member, curling rod or hair curler 10, a short length or sheet 12 of fluid impermeable material, and an elongated tubular sealing member or split sleeve 14.

The hair curler 10 is an exemplary form of winding element upon which a hair section can be wound. Other winding members can also be utilized, if desired, provided hair can be wound upon them in croquignole fashion. The curler 10 illustrated is made of a molded plastic composition and has a generally concave central body, as viewed in longitudinal cross section. That is, the central portion is of lesser diameter compared to the short, constant diameter end portions. This contour produces a rolled or wound hair section having a generally cylindrical configuration and a diameter approximating that of the curler ends.

The curler 10 includes a plurality of minute projections or teeth 16 which grip or anchor the free end of the hair section being wound upon the curler. In addition, the curler 10 includes an end kerf or slot 18 which anchors one end of an elastic cord 20, the opposite end of the cord 20 being similarly secured to an end plug or cap 22. The cap 22 includes a reduced diameter central portion adapted to fit within an opening (not shown) which is provided in the end of the curler 10 opposite the end with the slot 18.

By stretching the cord 20 over a section of hair that is rolled or wound on the curler 10, and placing the cap 22 in the complemental curler opening, the wound hair is retained in position for treatment.

The split sleeve 14, which is adapted to be fitted upon the curler 10, comprises an elongated tube having a lengthwise slot or split 24. The length of the sleeve 14 is such that when it is in position upon the curler 10 it is coextensive with all of the curler body except the constant diameter end portions.

Since the sleeve 14 is intended to fit over hair wound upon the curler 10, and since the wound hair has a substantially constant diameter configuration, the inner diameter of the sleeve 14 is preferably also made constant throughout its length. However, the configuration is not critical so long as the particular configuration utilized is effective to press down upon and seal the wound elements, as will be seen.

The outer configuration of the sleeve 14 is also not critical, but preferably it should be generally concave in longitudinal cross section like the curler 10. If the sleeve 14 is made generally concave any rolled or wound hair on the outside of the sleeve 14 will tend to have a neat, generally cylindrical contour.

The particular resilient polyethylene material of which the sleeve 14 is made is also not critical to the present invention. Many suitable alternative materials will immediately suggest themselves to those skilled in the art. Such materials should be resistant to the hair treatment materials employed and preferably they should be characterized by inherent resilience. That is, the sealing means utilized must be capable of forcibly pressing upon and clamping against the wound materials on the curler 10. However, this could be accomplished by auxiliary clamping means, if desired.

The resilience and slotted construction of the sleeve material allows it to be sprung or spread apart at the slot 24 so that it can be fitted over the material wound on the curler 10, and thereafter exert a bias against the enclosed wound material.

The margins defining the curler slot 24 are preferably feathered or tapered to provide edges of lesser thickness than the wall thickness of the sleeve 14. The thinner edges are more flexible and therefore better able to easily conform to the contour of the underlying materials on the curler 10. This establishes a good seal to prevent passage of hair treatment materials past the flexible slot edges.

A sleeve 14 made of tubular stock has been employed with success in practicing the present invention. However, an injection molded part would be equally satisfactory.

The fluid impermeable sheet 12 is preferably rectangular in form. Its composition is not critical to the present invention so long as it is impermeable to the particular hair treatment materials being used. A flexible parchment type of paper is effective for this purpose. However, any sheet material capable of being rolled up, and yet resistant to fluid passage, would be satisfactory. In this regard the phrase "fluid impermeable" designates the capacity to prevent passage of fluid hair treatment material in the form of pastes, liquids, lotions or the like.

Referring now to FIGS. 2–5, a hair curling procedure is begun by separating or isolating a hair strand, tress, or section 26. For the purposes of this description, the hair section 26 has been divided into a root or scalp portion 28 which extends outwardly from the scalp 30, a mid portion 32 which is covered in whole or in part by the sheet 12, and a free end portion 34.

A conventional "end paper" 36 is placed upon the end portion 34. As is well known to those skilled in the art, an end paper is a liquid absorbent, flexible and relatively soft material which facilitates attachment and winding of the end portion 34 upon the curler 10. The curler 10 is rotated in a clockwise direction, as seen in FIG. 3, and the end paper and hair section catch upon the curler teeth 16 during the rolling or winding operation.

The hair section 26 is illustrated as having previously curled hair portions 32 and 34, which is typical, and a newly grown portion 28, which is straight. The object in a hair curling procedure is to avoid treating the previously curled portions of the hair sections 26 since this would tend to make them brittle and frizzy. Consequently, once the end portion 34 and the end paper 36 are partially rolled onto the curler 10, the fluid impermeable sheet 12 is used to protect the previously curled hair portions. For this purpose the sheet 12 is placed with its outer or trailing edge 38 in a position generally overlying the line of demarcation between the curled and uncurled portions of the hair section 26.

Clockwise winding of the curler 10 is continued until the curled hair portions 32 and 34 and the associated end paper 36 and sealing sheet 12 are completely rolled or wound upon the curler 10. The split sleeve 14 is then press fitted over the wound materials on the curler 10, as best seen in FIG. 4. One of the margins of the slot 24 is preferably located on or adjacent the sheet edge 38 so that the bias of the sleeve material presses the edge 38 into close conformity with the underlying wound materials. This effects a good seal against intrusion of the hair curling solution.

After the sleeve 14 is in position, the remaining uncurled scalp portion 28 is wound upon the outer surface of the sleeve 14 until the assembly is located adjacent the scalp 30. The curler cord 20 is then stretched across the wound material and the cap 22 is inserted within the complemental curler opening to retain the materials in wound position.

The foregoing procedure is repeated for other hair sections 26, and then the hair curling solution (not shown) is applied to the hair convolutions located exteriorly of the sleeve 14. This subjects the uncurled hair to the desired curling action, while protecting the already curled hair portions from this action.

A similar procedure is followed during a hair straightening procedure. However, the mid and end hair portions 32 and 34 are typically straight, having been previously straightened, while the scalp portion 28 would be wavy, kinky, or unstraightened. Therefore, after the hair portions 32 and 34, the end paper 36, and the sheet 12 are wound onto the curler 10, as previously described in connection with the hair curling procedure, and the sleeve 14 is placed in sealing position, the remaining scalp portion 28 is not wound onto the sleeve 14. Instead the scalp portion 28 is left as is and for application of the hair straightening lotion (not shown) to it.

Referring now to FIG. 6, a hair frosting arrangment is illustrated. In a hair frosting procedure according to the present invention, a block or tress of hair is separated from the main body of hair and this, in turn, is divided into two sections. Such division is best accomplished by passing a tool such as the end of a rat-tail comb in and out of the hair tress in basket-weave fashion. As the comb end is alternately passed in and out through the hair tress in this fashion, the alternate hair strands are passed upwardly to define an upper hair section 26, and downwardly to define an upper hair section 26.

The lower one of the adjacent hair sections 26 is wound onto a hair curler 10 in a manner identical to that described previously in connection with a hair curling procedure except that the fluid impermeable sheet 12 is placed on the hair section 26 with its edge 38 closely adjacent the scalp 30, and all of the lower hair section is wound on the curler 10 before placing the sleeve 14 in position. This seals all of the rolled or wound hair against intrusion of the hair frosting material since no part of the hair is located exteriorly of the sleeve 14.

If desired, one edge of a generally rectangular length of protective sheet material, such as aluminum foil 40, could be placed adjacent an edge margin of the sleeve slot 24 when the sleeve is being pressed into position. The clamping action of the sleeve 14 then holds the edge of the foil 40 in position, and the remainder of the foil drops down and rests against the scalp 30. The previously separated upper hair section 26 is then placed on top of the foil 40 where it is easily accessible for treatment by the hair frosting bleaching agent. The foregoing procedure is repeated until a number of the upper hair sections 26 are located on sheets of foil 40 and have been treated by the frosting agent (not shown). Use of the foil prevents any possible seepage of the bleaching agent onto other parts of the hair which are not to be treated. However, if all of the other parts of the hair not to be treated are already wound onto curlers 10, then the foil 40 can be eliminated.

In a reverse hair frosting procedure, the procedure is identical to that just described except that, instead of a bleaching agent, a hair dyeing agent (not shown) is used to dye the hair sections 26 arranged on the sheets of foil 40.

From the foregoing it is seen that the present apparatus and method provide a rapid and easy means for isolating selected hair sections for protection from hair treatment materials. Utilization of the present apparatus enables the practice of unique hair treatment methods which greatly speed hair curling, straightening, and frosting operations.

Various modifications and changes may be made with regard to the foregoing detailed description without departing from the spirit of the invention.

I claim:

1. An apparatus for isolating sections of hair from hair treatment materials, said apparatus comprising:

an elongated winding member on which a hair section is adapted to be wound;

a sheet of material impermeable to said hair treatment materials and adapted to overlie said hair section for winding onto said winding member with said hair section; and a sealing member adapted for fitting onto said winding member in overlying relation to the wound up hair section and said sheet and operative to press upon and seal said hair section and said sheet from hair treatment materials.

2. An apparatus according to claim 1 wherein said sealing member is an elongated split sleeve made of resilient material whereby said sleeve is adapted to be sprung apart at the split for said fitting onto said winding member.

3. An apparatus according to claim 2 wherein the margins of said sleeve defining said split are each tapered to a thickness less than the wall thickness of said sleeve.

4. A hair treatment method characterized by isolation of portions of hair from the hair treatment materials, said method comprising the steps of:

winding the free end portion of a hair section onto an elongated winding member;

placing a sheet of material adjacent the mid portion of said hair section, said sheet of material being impermeable to the hair treatment material to be used;

winding said mid portion of said hair section and said sheet together onto said winding member;

placing sealing means on said winding member in overlying close fitting relation to the wound up end portion, mid portion and sheet for sealing the same against the hair treatment materials;

repeating the foregoing steps on other hair sections to be isolated; and applying hair treatment materials to unisolated hair sections.

5. A hair treatment method according to claim 4 wherein the hair treatment method is for curling the scalp end portions of hair sections whose free end portions and mid portions were previously curled, and including the steps of: taking the scalp end portion of each hair section sealed by said sealing means and winding said scalp end portion upon said sealing means; retaining the wound up hair portions and sheet in wound condition on said winding member and sealing means; and applying hair curling material to the wound said scalp end portions.

6. A hair treatment method according to claim 4 wherein the hair treatment method is for straightening the scalp end portions of hair sections whose free end portions and mid portions were previously straightened, and including the steps of: taking the scalp end portion of each hair section sealed by said sealing means and applying hair straightening material to it.

7. A hair treatment method characterized by isolation of sections of hair from the hair treatment materials, said method comprising the steps of:

weaving a tool in and out of a section of hair to provide adjacent first and second hair portions each constituted of alternate hair strands from said section;

winding the free extremity of one of said first hair portions onto an elongated winding member;

placing a sheet of material adjacent the scalp extremity of said first hair portion, said sheet of material being impermeable to the hair treatment material to be used;

winding all of said first portion and said sheet together onto said winding member;

placing sealing means on said winding member in overlying, close fitting relation to said wound up first portion and said sheet for sealing the same against the hair treatment materials, and simultaneously placing under said adjacent second hair portion a protective sheet;

repeating the foregoing steps on other first and second hair portions; and applying hair treatment materials to said second hair portions.

8. A hair treatment method according to claim 7 wherein the hair treatment materials applied in said last step comprise bleaching materials whereby said hair treatment constitutes a hair frosting procedure.

9. A hair treatment method according to claim 7 wherein the hair treatment materials applied in said last step comprise dyeing materials whereby said hair treatment constitutes a reverse frosting procedure.

* * * * *